US006854715B2

(12) United States Patent
Hicks et al.

(10) Patent No.: US 6,854,715 B2
(45) Date of Patent: Feb. 15, 2005

(54) ANTI FALL DEVICE

(76) Inventors: Chris Hicks, Box 98, 219 South Service Road, Grimsby, Ontario (CA), L3M 4G1; Jacek Kaminski, Box 98, 219 South Service Road, Grimsby, Ontario (CA), L3M 4G1

( * ) Notice: Subject to any disclaimer, the term of this patent is extended or adjusted under 35 U.S.C. 154(b) by 59 days.

(21) Appl. No.: 10/267,636

(22) Filed: Oct. 10, 2002

(65) Prior Publication Data

US 2004/0069979 A1 Apr. 15, 2004

(51) Int. Cl.[7] ..... B66F 3/24
(52) U.S. Cl. ..... 254/122
(58) Field of Search ..... 254/122, 124, 254/126, 322, 328; 187/8.41, 8.47

(56) References Cited

U.S. PATENT DOCUMENTS 4,625,944 A * 12/1986 Mankey et al. ..... 254/8 R
4,724,930 A * 2/1988 VanLierop ..... 187/204
4,848,732 A * 7/1989 Rossato ..... 254/90
4,984,774 A * 1/1991 Zupancic et al. ..... 5/601
5,012,898 A * 5/1991 Tsymberov ..... 187/208
5,299,658 A * 4/1994 Cox et al. ..... 187/209
5,829,948 A * 11/1998 Becklund ..... 414/607

* cited by examiner

*Primary Examiner*—Robert C. Watson

(57) ABSTRACT

The present invention is an anti fall device for use with scissor type mechanically actuated lifting devices. The anti fall device comprises a a slave safety hydraulic cylinder capable of supporting a lifting device upon failure of a drive assembly thereby arresting descent of the lifting device when the lifting device is normally stationary or moving upwardly and a drive assembly of the lifting device fails and the lifting device begins to descend uncontrollably. The hydraulic cylinder includes a one way check valve for preventing reverse hydraulic fluid flow upon uncontrolled descent of the lifting device thereby arresting movement of the hydraulic cylinder and arresting descent of the lifting device. The invention also includes an hydraulic velocity fuse in fluid communication with the hydraulic cylinder. The velocity fuse is triggered at a preselected fluid flow rate for controllably lowering the lifting device.

19 Claims, 7 Drawing Sheets

PLATFORM MOVING UPWARDS

PLATFORM MOVING DOWNWARDS

ANTI FALL DEVICE

FIELD OF THE INVENTION

The present invention relates to lift safety devices and more particularly relates to lift anti fall devices.

BACKGROUND OF THE INVENTION

Lifting devices which are mechanically or hydraulically actuated, are used in many different industries for raising and lowering components for assembly operations and the like. There are a number of different lift designs, however, scissor type lifts are one of the most frequently used. Scissor lifts are usually actuated by either hydraulic cylinders or mechanical screw drives.

Hydraulically actuated and/or mechanically actuated scissor lifts are used extensively in the automotive industry, particularly on automotive assembly lines. By way of example only, in this patent, we will describe the anti fall device which is the subject matter of this patent used in association with a mechanically actuated scissor lift.

Vehicles are often assembled on a platform which can be raised or lowered, for the purpose of assembly and mounting of various components onto the vehicle as it progresses down the assembly line. The automotive industry is extremely concerned about safety. An uncontrolled descent of a scissor lift could present a substantial safety hazard to workers that are situated in and around the scissor lift when for example, installing componentry on the vehicle. It is desirable to have safety devices which, upon failure of the drive mechanism of the lift, would prevent uncontrolled descent of the scissor lift platform, in order to minimize and/or prevent injury to personnel.

Currently, the specifications which deal with the safety aspect of scissor lifts include ANSI Specification MH 29.1 Section 8.1.2 which calls for a rate of descent protection, wherein the descent of the lift is promptly arrested or the rate of descent limited to a speed not to exceed the greater of 4 times the normal down speed or 30 feet per minute when fully loaded.

General Motors also have their own internal specification, GMSC 1-99, Section 2.3.13 which calls for an anti fall safety device which senses an over speed condition and arrests the dropping of the scissor lift unit within two inches of travel from the point of detection.

The present invention an anti fall device to be used in association with lifting devices, and particularly mechanical operated scissor lifts, detects catastrophic failure of the drive mechanism and minimizes unwanted descent or uncontrolled rates of descent of the lifts.

SUMMARY OF THE INVENTION

The present invention includes a method for preventing uncontrolled descent of a scissor lift comprising:

a) arresting descent of a scissor lift with an safety hydraulic cylinder when a scissor lift is initially stationary or moving upwardly and a scissor lift fails and begins to descend uncontrollably.

Preferably wherein said hydraulic cylinder including a slave safety hydraulic cylinder capable of supporting a scissor lift device upon failure of a scissor device.

The present invention includes an anti fall device for use with scissor type mechanically actuated lifting devices, said anti fall device comprising:

a) a means for arresting descent of a lifting device when a lifting device is normally stationary or moving upwardly and a drive assembly of a lifting device fails and a lifting device begins to descend uncontrollably.

Preferably wherein said arresting means including a slave safety hydraulic cylinder capable of supporting a lifting device upon failure of a drive assembly.

Preferably wherein said hydraulic cylinder including a one way check valve for preventing reverse hydraulic fluid flow upon uncontrolled descent of a lifting device thereby arresting movement of said hydraulic cylinder and arresting descent of a lifting device.

Preferably wherein said drive assembly including a ball screw/ball nut type mechanical drive.

Preferably further including a means for controlling descent of a lifting device when a lifting device normally moving downwardly and a lifting device fails and begins to descend uncontrollably.

Preferably wherein said control means includes an hydraulic velocity fuse in fluid communication with said hydraulic cylinder, said velocity fuse triggered at a preselected fluid flow rate for controllably lowering a lifting device.

Preferably wherein said control means includes an hydraulic velocity fuse fluidly connected in series with a release solenoid defining a circuit A for allowing fluid flow through said velocity fuse when a lifting device moving downwardly and for closing off said circuit A when a lifting device is stationary or moving upwardly.

Preferably further including a lowering means for manually lowering a lifting device at a controlled rate of descent.

Preferably wherein said lowering means including a normally closed manual lowering valve fluidly connected to a circuit B which is in parallel to circuit A for manually controlling hydraulic fluid flow to said safety hydraulic cylinder thereby manually lowering said lifting device.

Preferably wherein said control means housed within a safety manifold which is in fluid communication with said hydraulic cylinder.

The present invention includes in combination an anti fall device and a lifting device comprising:

a) a means for arresting descent of said lifting device when said lifting device is normally stationary or moving upwardly and a drive assembly of said lifting device fails and said lifting device begins to descend uncontrollably.

Preferably wherein said arresting means including a slave safety hydraulic cylinder moving in conjunction with said lifting device capable of supporting said lifting device upon failure of said drive assembly.

Preferably wherein said hydraulic cylinder including a one way check valve for preventing hydraulic fluid flow upon uncontrolled descent of said lifting device thereby arresting movement of said hydraulic cylinder and arresting descent of said lifting device.

Preferably wherein said drive assembly including a ball screw/ball nut type mechanical drive.

Preferably wherein said lifting device including a scissor type lift.

Preferably further including a means for controlling descent of a lifting device when a lifting device normally moving downwardly and a lifting device fails and begins to descend uncontrollably.

Preferably wherein said control means includes an hydraulic velocity fuse in fluid communication with said hydraulic cylinder, said velocity fuse triggered at a preselected fluid flow rate for controllably lowering a lifting device.

Preferably wherein said control means includes an hydraulic velocity fuse fluidly connected in series with a release solenoid defining a circuit A for allowing fluid flow through said velocity fuse when a lifting device moving downwardly and for closing off said circuit A when a lifting device is stationary or moving upwardly.

Preferably further including a lowering means for manually lowering a lifting device at a controlled rate of descent.

Preferably wherein said lowering means including a normally closed manual lowering valve fluidly connected to a circuit B which is in parallel to circuit A for manually controlling hydraulic fluid flow to said safety hydraulic cylinder thereby manually lowering said lifting device.

Preferably wherein said control means housed within a safety manifold which is in fluid communication with said hydraulic cylinder.

Preferably further including the step of controlling descent of a scissor lift with a velocity fuse when a scissor lift normally moving downwardly and a lifting device fails and begins to descend uncontrollably.

Preferably wherein said velocity fuse in fluid communication with said hydraulic cylinder, said velocity fuse triggered at a preselected fluid flow rate for controllably lowering a scissor lift.

a) arresting descent of a scissor lift with an hydraulic cylinder when a scissor lift is initially stationary or moving upwardly and a scissor lift fails and begins to descend uncontrollably.

DETAILED DESCRIPTION OF THE PREFERRED EMBODIMENT

Definitions

Scissor Lift: A raising/lowering device that is supported by one or more pantograph legs sections.

Velocity fuse: A hydraulic safety valve that will close (and remain closed) when the velocity of fluid moving through the valve exceeds a predetermined rate. Hydraulic pressure must be applied to the base port to release a locked velocity fuse.

Check valve: A device that allows flow of a liquid or gas in one direction only, this includes hydraulic valves that can be controlled manually, pneumatically or hydraulically to selectively block or permit fluid flow as required. For purpose of this application by way of example the term check valve includes but is not limited to present day check valves, pilot operated check valves, poppet valves which are unidirectional and bidirectional, spools, and directional control valves.

The present invention an anti fall device shown generally as 20 in the Figures, includes a safety hydraulic cylinder 100 and a safety manifold 200 which is mounted on and used in conjunction with lifting devices and preferably used in conjunction with a scissor lift 50 as shown in the Figures.

Figure 5:
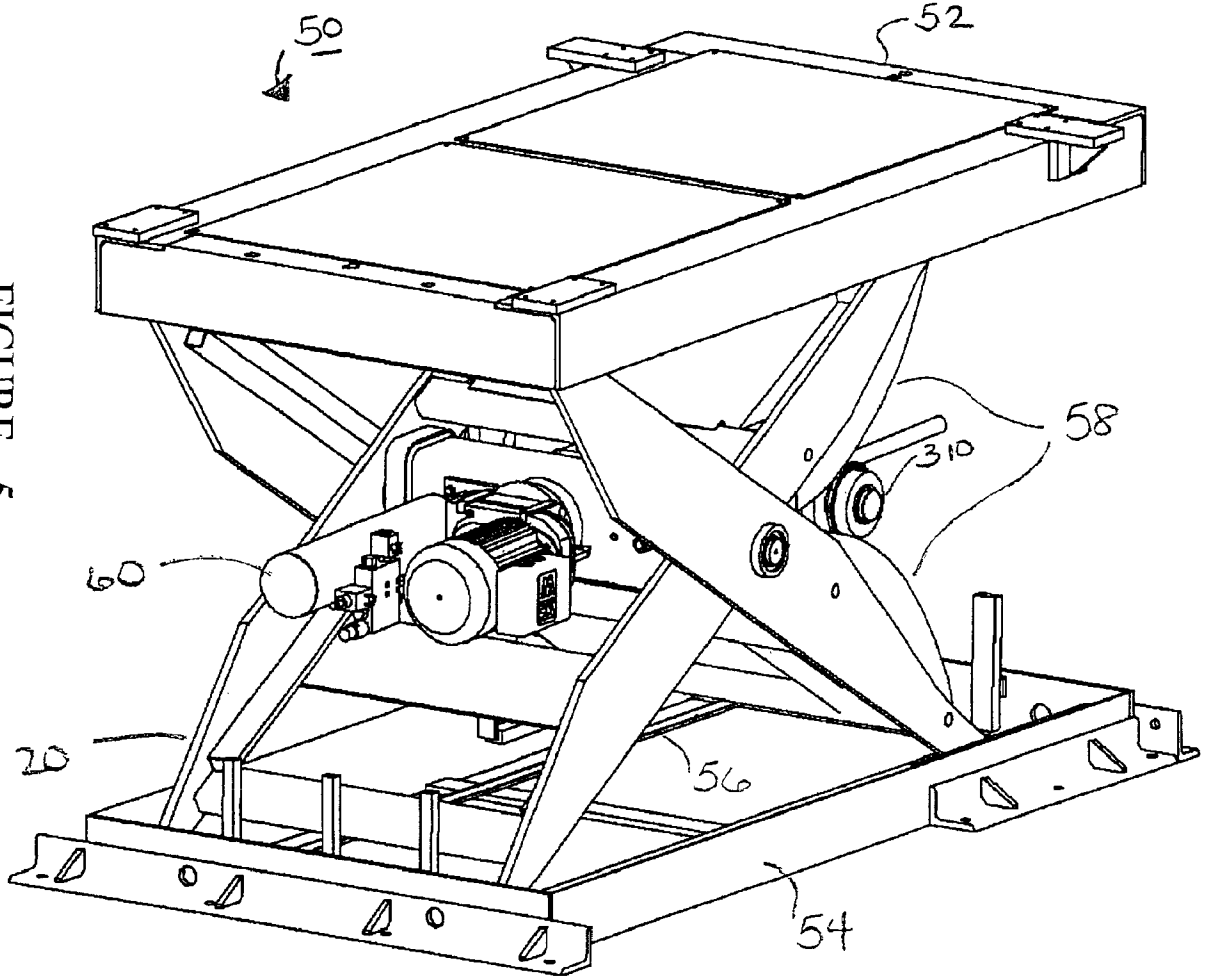
FIG. 5 is an upright perspective schematic view of a mechanical scissor lift with the drive assembly and platform and base.

The present invention anti fall device 20 will be shown deployed in a scissor lift 50. Those skilled in the art will recognize that the anti fall device 20 can also be used with lifting devices having configurations other than the one depicted in the attached Figures. For the purposes of explaining the present invention anti fall device 20, we have chosen to depict anti fall device 20 deployed in a simple scissor lift 50 having a mechanical type drive mechanism. Scissor Lift Components Referring now specifically to FIGS. 5, 6 and 7 a scissor lift shown generally as 50 includes the following major components, namely: platform 52, base 54, legs 56 having cams 58 mounted thereon and a drive assembly 60 having the anti fall device 20 incorporated therein. The function of scissor lift 50 is simply to raise and lower platform 52 to a preselected and predetermined height in a controllable fashion through microprocessor and/or other mechanical control means. The lift shown as scissor lift 50 in FIG. 5 is used in various industries for various purposes and particularly is used in the automotive industry for sub assembly and final assembly of automotive components and vehicles. Personnel are often moving in and around scissor lift 50 during its operation and therefore, unpredictable lowering or raising of platform 52 is undesirable in that it can cause bodily injury to persons in the near vicinity of scissor lift 50.

To address this issue, the present invention anti fall device 20 has been adapted to minimize and/or prevent uncontrolled descent or fall of platform 52.

Figure 6:
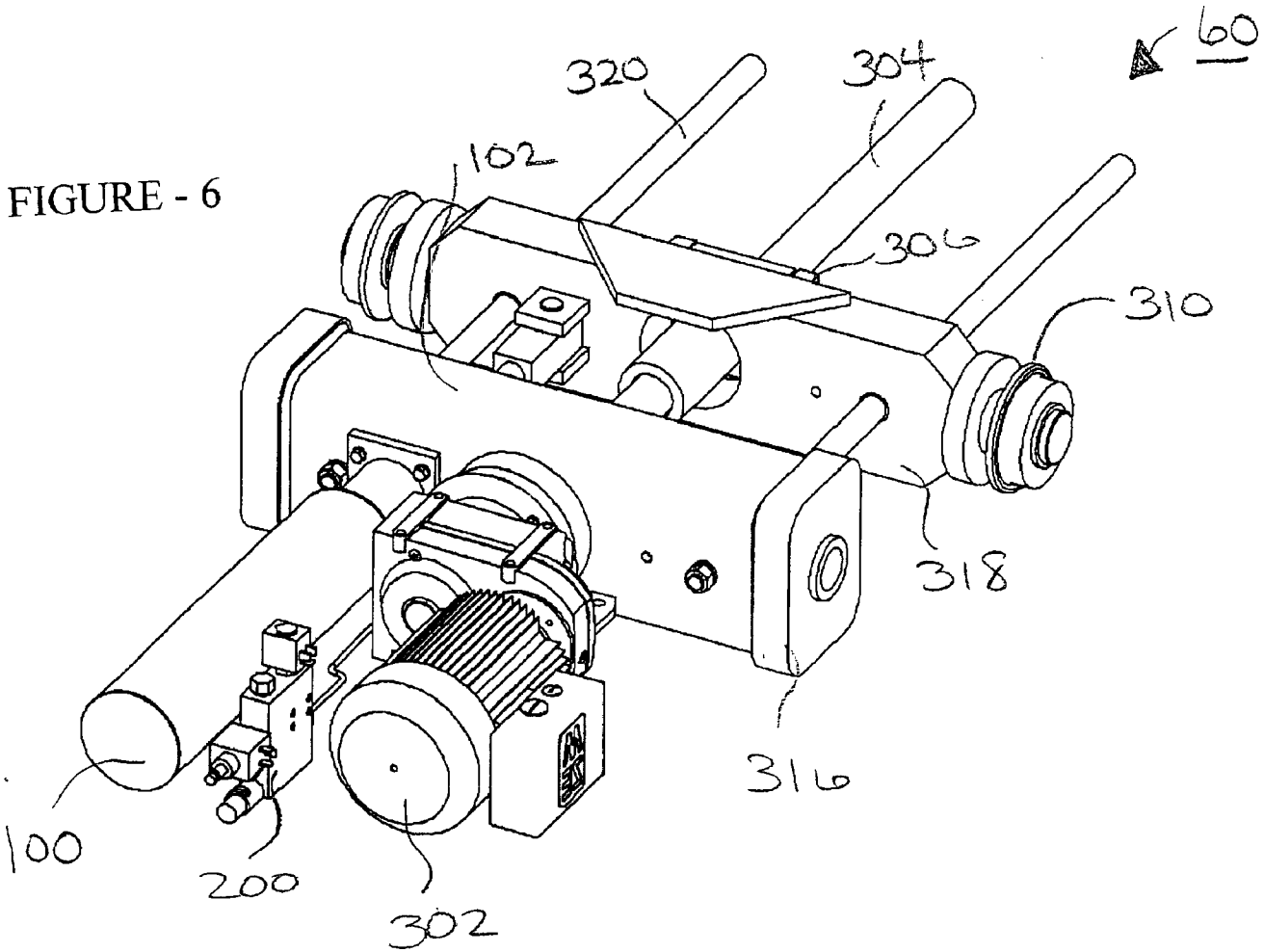
FIG. 6 is a schematic perspective view of the drive assembly apart from the lift.
Figure 7:
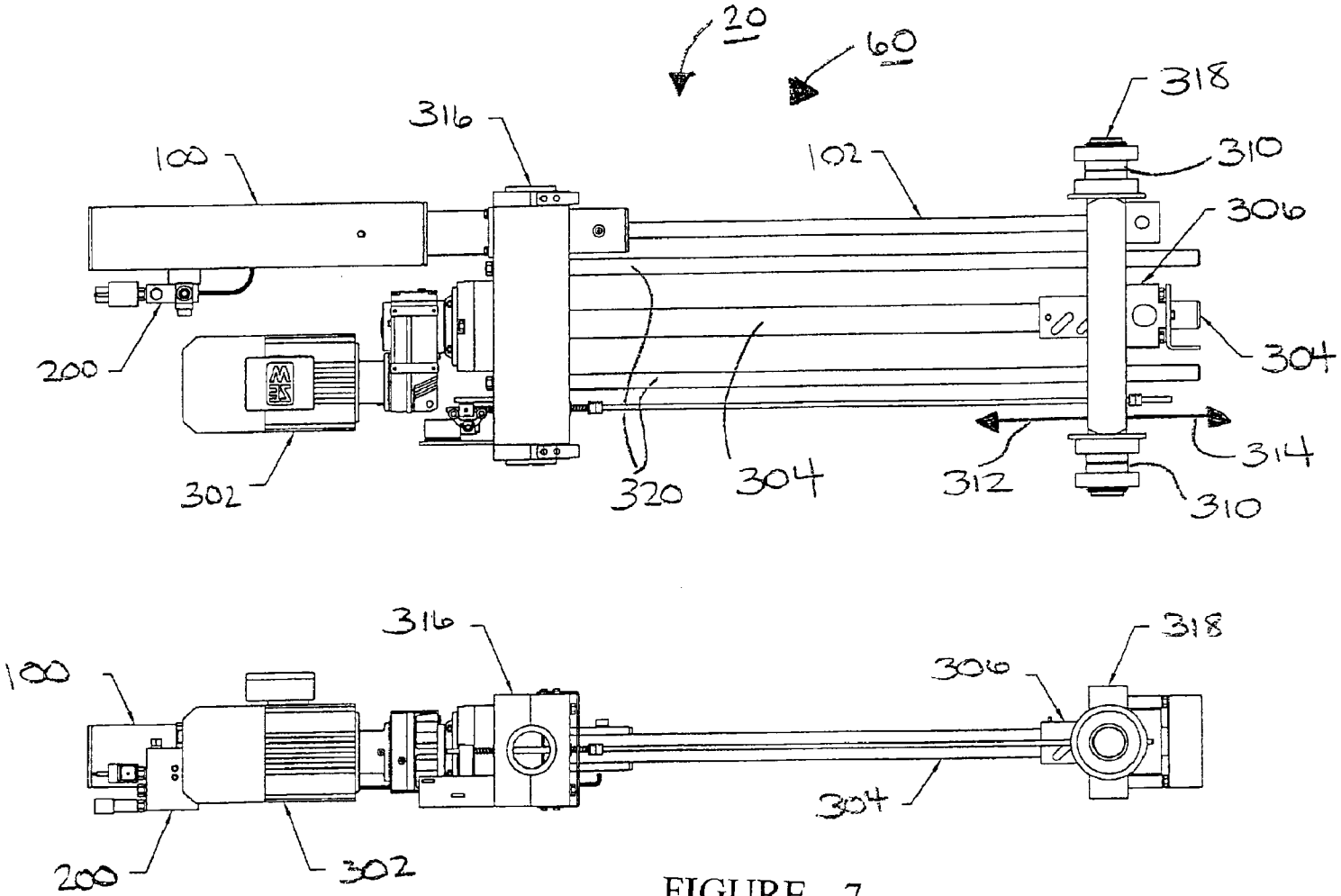
FIG. 7 is a plan and side view of the drive assembly showing the anti fall device including the safety hydraulic cylinder and safety manifold.

Referring now to FIGS. 6 and 7 which depict drive assembly 60, the major components of drive assembly 60 include anti fall device 20 which includes safety hydraulic cylinder 100 and safety manifold 200 deployed onto drive assembly 60 as shown in FIGS. 6 and 7.

Drive assembly 60 includes a gear motor 302 for a rotatably driving ball screw 304 which in turn interacts with ball nut 306 for linearly urging strong back 318 back and forth along guide rods 320. Gear motor 302 is connected to ball screw 304 via a transmission and axle pin tube 316 and it interacts with ball nut 306, such that rotation in one direction of ball screw 304 retracts strong back 318 in direction 312 thereby raising platform 52 through the interaction of cam followers 310 with cams 58 located on legs 56 of scissor lift 50.

On the other hand rotating ball screw 304 in the opposite direction, extends strong back 318 in direction 314 therefore allowing cam followers 310 to move along cams 58 in such a manner that platform 52 is lowered.

This mechanical structure is well known in the art and utilized for many applications including mechanical scissor lifts as shown as 50. Different variations and/or geometries can be used which essentially provide for the same affect, namely the raising and lowering of a platform 52.

Most failures of scissor lift 50 occur in the drive assembly 60, namely failure of the ball nut 306/ball screw 304 arrangement or some system failure in the gear motor 302 which includes a motor brake and other mechanical components.

Anti fall device 20 is effective in preventing catastrophic or uncontrolled falling of platform 52 when failure of drive assembly 60 occurs. Anti fall device 20 will in many instances be ineffective in preventing fall of platform 52 if there is a catastrophic failure of a major structural component of scissor lift 50 such as collapse of one of the legs 56.

This type of scissor lift failure is however, much less frequent than failure of drive assembly 60 and therefore, it is desirable to have some type of anti fall mechanism which would prevent uncontrolled descent of platform 52, should there be a drive assembly 60 failure.

Anti Fall Device Components

Figure 4:
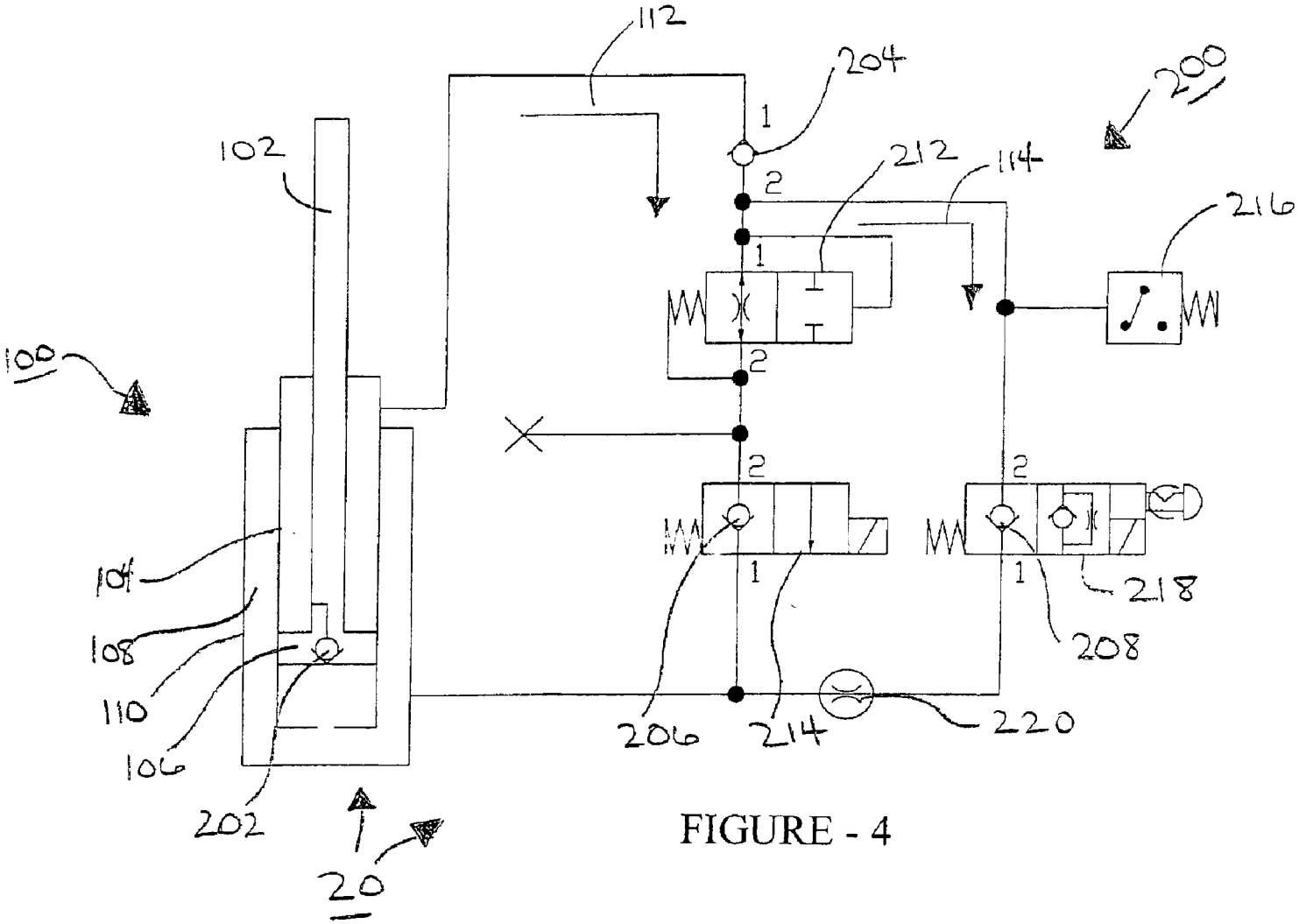
FIG. 4 is a schematic hydraulic circuit diagram showing the safety hydraulic cylinder together with the safety manifold components.

Anti fall device 20 includes the following major components namely: safety hydraulic cylinder 100 and safety manifold 200. Referring now to FIG. 4 which schematically depicts the hydraulic circuitry of safety hydraulic cylinder 100 as well as safety manifold 200, anti fall device 20 will now be described with reference to FIG. 4.

Anti fall device shown generally as 20 is comprised of two major components, namely safety hydraulic cylinder 100 which is operably connected to safety manifold 200.

Safety hydraulic cylinder 100 is preferably a hydraulic cylinder having a cylinder rod 102, cylinder wall 104, piston 106, fluid reservoir 108, reservoir casing 110 and a check valve 202. Safety hydraulic cylinder 100 is essentially a slave cylinder in that under normal operating conditions it does not impart lifting forces to raise or lower platform 52 of scissor lift 50. The normal lifting and lowering operations of scissor lift 50 are carried out by drive assembly 60 which consists of mechanical drive including a ball screw 304/ball nut 306 arrangement. Gear motor 302 imparts the forces necessary to raise and lower platform 52 of scissor lift 50.

Therefore, safety hydraulic cylinder 100 is essentially a passive hydraulic cylinder which becomes active in the case when a catastrophic failure of drive assembly 60 occurs, such as when ball nut 306 fails or when there is failure of the drive system motor brake.

Safety manifold 200 which is operably connected to safety hydraulic cylinder 100 is the hydraulic controlling circuits which become active during catastrophic failure of the drive systems. Safety manifold 200 includes two major hydraulic circuits namely, circuit A denoted as 112 and circuit B denoted as 114 in FIG. 4.

Circuit A includes check valve 204, a velocity fuse 212, a release solenoid 214 having a check valve 206 therein.

Circuit B 114 includes a pressure switch 216, a manual lowering valve 218, including a check valve 208 therein as well as a fixed orifice 220.

The operation of safety hydraulic cylinder 100 together with safety manifold 200 is best described by breaking it down into three distinct motions of scissor lift 50. Namely:

1. With platform 52 moving upwards.
2. With platform 52 stationary.
3. With platform 52 moving downwards.

Platform Moving Upwards

Figure 1:
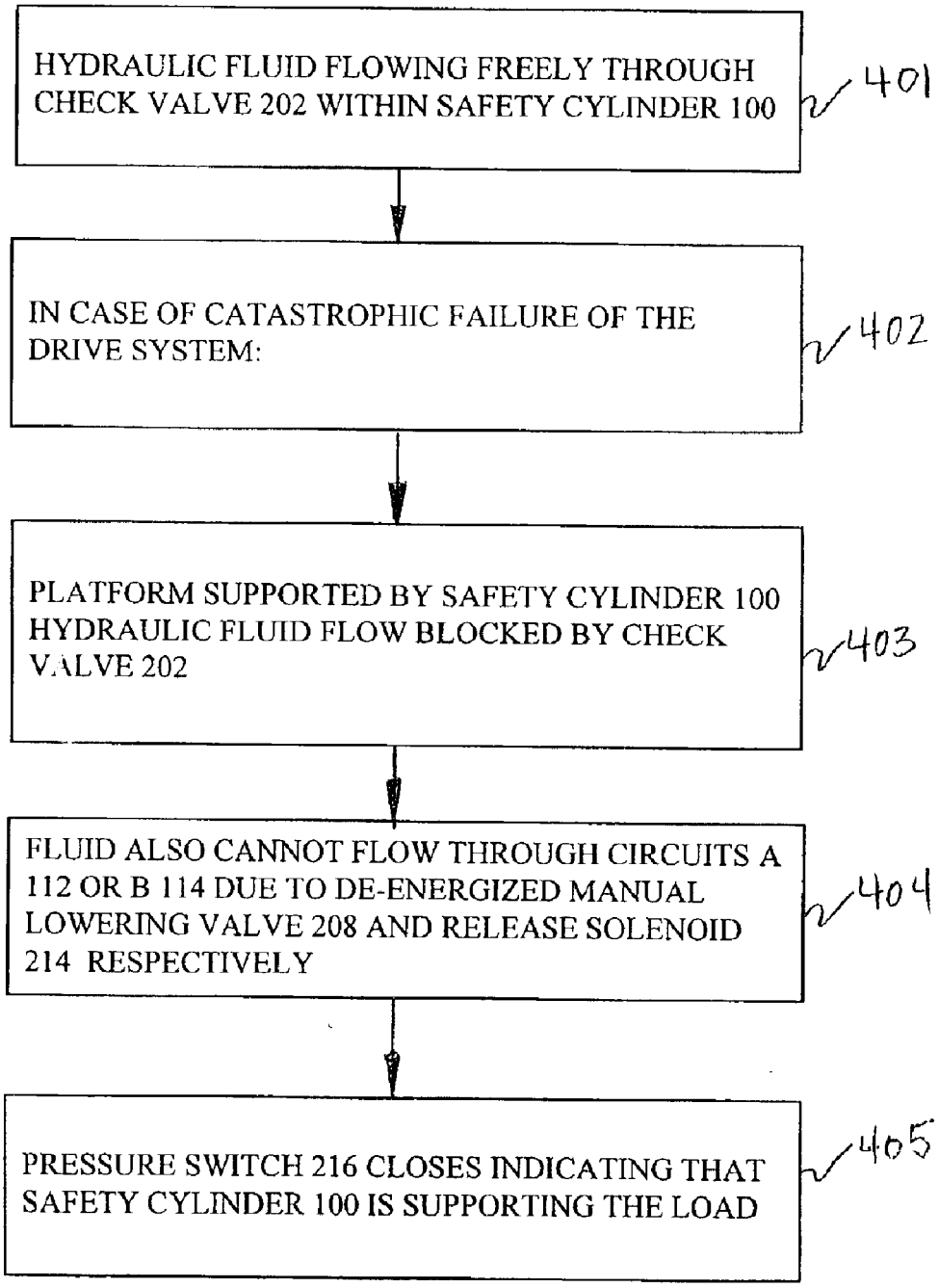
FIG. 1 is a flow chart indicating the steps of operations of the anti fall device when the platform is moving upwards.
Figure 2:
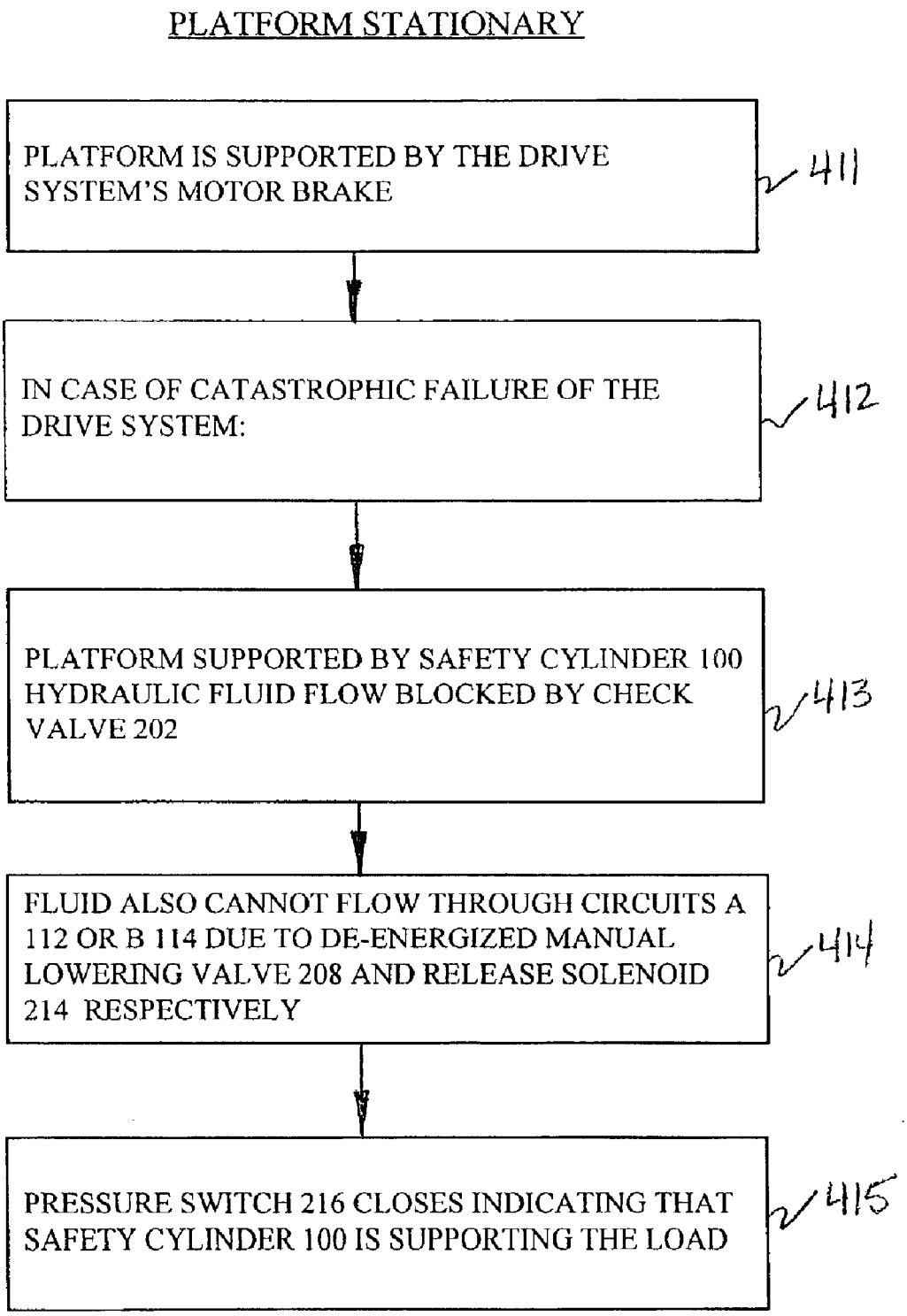
FIG. 2 is a flow chart indicating the steps of operation of the anti fall device when the platform is in the stationary position.
Figure 3:
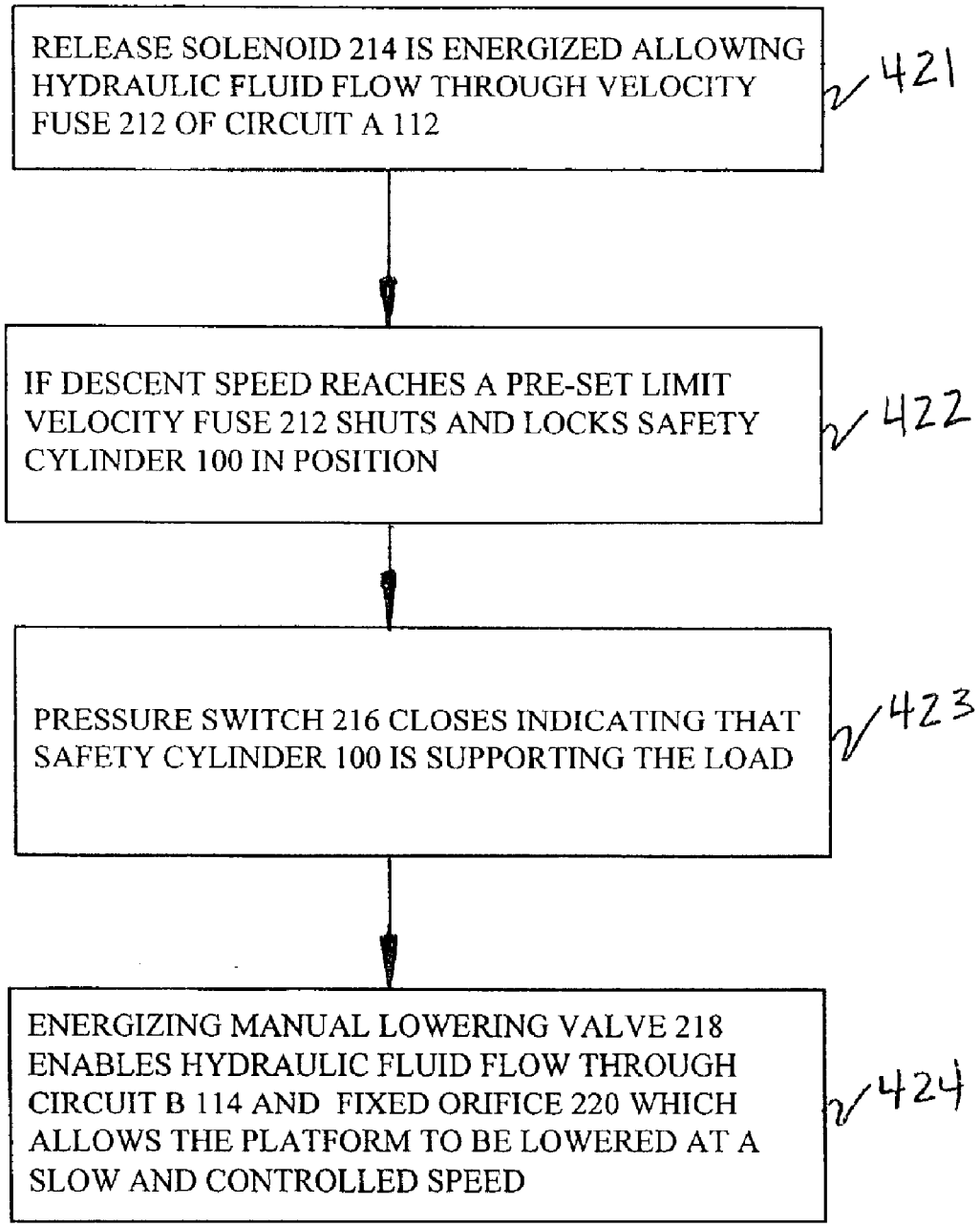
FIG. 3 is a flow chart showing the steps of operation of the anti fall device when the platform is moving in the downwards direction.

Referring now to FIG. 1, the sequence of operations when the platform is moving upward is described in FIG. 1 and here below.

1. Hydraulic fluid is flowing freely through check valve 202 within safety hydraulic cylinder 100—shown as 401.
2. In case of catastrophic failure of the drive system:—shown as 402.
3. The platform becomes supported by safety hydraulic cylinder 100 since hydraulic fluid flow is blocked by check valve 202—shown as 403.
4. Hydraulic fluid also cannot flow through circuits a 112 or b 114 due to a de-energized manual lowering valve 208 and a de-energized release solenoid 214 respectively—shown as 404.
5. Pressure switch 216 closes indicating that safety hydraulic cylinder 100 is supporting the load—as shown in 405.

Platform Stationary

With the platform stationary:

1. Platform is supported by the drive system's motor brake—as shown in 411.
2. In case of catastrophic failure of the drive system—as shown in 412.
3. The platform is supported by safety hydraulic cylinder 100 and hydraulic fluid flow is blocked by check valve 202—as shown in 413.
4. Hydraulic fluid also cannot flow through circuits a 112 or b 114 due to a de-energized manual lowering valve 208 and a de-energized release solenoid 214 respectively—as shown in 414.
5. Pressure switch 216 closes indicating that safety hydraulic cylinder 100 is supporting the load—as shown in 415.

Platform Moving Downwards

With the platform moving downwards:

1. Release solenoid 214 is energized allowing hydraulic fluid flow through velocity fuse 212 of circuit a 112—as shown in 421.
2. If descent speed reaches a pre-set limit velocity fuse 212 shuts and locks safety hydraulic cylinder 100 in position—as shown in 422.
3. Pressure switch 216 closes indicating that safety hydraulic cylinder 100 is supporting the load—as shown in 423.
4. Energizing manual lowering valve 218 enables hydraulic fluid flow through circuit b 114 and fixed orifice 220 which allows the platform to be lowered at a slow and controlled speed—as shown in 424.

It should be apparent to persons skilled in the arts that various modifications and adaptation of this structure described above are possible without departure from the spirit of the invention the scope of which defined in the appended claim.

We claim:

1. An anti fall device for use with scissor type mechanically actuated lifting devices, said anti fall device comprising:

a) a means for arresting descent of the lifting device when the lifting device is normally stationary or moving upwardly and a drive assembly of the lifting device fails and the lifting device begins to descend uncontrollably; and b) wherein said arresting means including a slave safety hydraulic cylinder operably connected to the lifting device capable of supporting the lifting device upon failure of the drive assembly;

(c) wherein said slave safety hydraulic cylinder including a one way check valve for preventing reverse hydraulic fluid flow upon uncontrolled descent of the lifting device thereby arresting movement of said slave safety hydraulic cylinder and arresting descent of the lifting device; and d) wherein said drive assembly including a ball screw/ball nut type mechanical drive.

2. The anti fall device claimed in claim 1, further including a means for controlling descent of the lifting device when the lifting device normally moving downwardly and begins to descend uncontrollably.

3. The anti fall device claimed in claim 2, wherein said control means includes an hydraulic velocity fuse in fluid communication with said slave safety hydraulic cylinder, said velocity fuse triggered at a preselected fluid flow rate for controllably lowering the lifting device.

4. The anti fall device claimed in claim 3, wherein said control means includes an hydraulic velocity fuse fluidly connected in series with a release solenoid defining a circuit A for allowing fluid flow through said velocity fuse when the lifting device is moving downwardly and for closing off said circuit A when the lifting device is stationary or moving upwardly.

5. The anti fall device claimed in claim 4, further including a lowering means for manually lowering the lifting device at a controlled rate of descent.

6. The anti fall device claimed in claim 5 wherein said lowering means including a normally closed manual lowering valve fluidly connected to a circuit B which is in parallel to circuit A for manually controlling hydraulic fluid flow to said slave safety hydraulic cylinder thereby manually lowering said lifting device.

7. The anti fall device claimed in claim 6 wherein said control means housed within a safety manifold which is in fluid communication with said slave safety hydraulic cylinder.

8. In combination an anti fall device and a lifting device comprising:

a) a means for arresting descent of said lifting device when said lifting device is normally stationary or moving upwardly and a drive assembly of assembly of said lifting device fails and said lifting device begins to descend uncontrollably;

b) wherein said arresting means including a slave safety hydraulic under moving in conjunction with said lifting device and operably connected to the lifting device capable of supporting said lifting device upon failure of said drive assembly;

c) wherein said slave safety cylinder including a one way check valve for preventing hydraulic fluid flow upon uncontrolled descent of said lifting device thereby arresting movement of said slave safety hydraulic cylinder and arresting descent of said lifting device; and d) wherein said drive assembly including a ball screw/ball nut type mechanical drive.

9. The combination claimed in claim 8, wherein said lifting device including a scissor type lift.

10. The combination claimed in claim 8, further including a means for controlling descent of a lifting device when a lifting device normally moving downwardly and a lifting device fails and begins to descend uncontrollably.

11. The combination claimed in claim 10, wherein said control means includes an hydraulic velocity fuse in fluid communication with said slave safety hydraulic cylinder, said velocity fuse triggered at a preselected fluid flow rate for controllably lowering a lilting device.

12. The combination claimed in claim 11, wherein said control means includes an hydraulic velocity fuse fluidly connected in series with a release solenoid defining a circuit A for allowing fluid flow through said velocity fuse when the lifting device moving downwardly and for closing off said circuit A when the lifting device is stationary or moving upwardly.

13. The combination claimed in claim 12, further including a lowering means for manually lowering the lifting device at a controlled rate of descent.

14. The combination claimed in claim 13 wherein said lowering means including a normally closed manual lowering valve fluidly connected to a circuit B which is in parallel to circuit A for manually controlling hydraulic fluid flow to said slave safety hydraulic cylinder thereby manually lowering said lifting device.

15. The combination claimed in claim 14 wherein said control means housed within a safety manifold which is in fluid communication with said slave safety hydraulic cylinder.

16. An anti fall device for use with scissor type mechanically actuated lifting devices, said anti fall device comprising:

a) a means for arresting descent of the lifting device when the lifting device is normally stationary or moving upwardly and a drive assembly of the lifting device fails and the lifting device begins to descend uncontrollably;

b) wherein said arresting means including a slave safety hydraulic cylinder operably connected to said lifting device capable of supporting the lifting device upon failure of the drive assembly;

c) wherein said slave safety hydraulic cylinder including a one way check valve for preventing reverse hydraulic fluid flow upon uncontrolled descent of the lifting device thereby arresting movement of said slave safety hydraulic cylinder and arresting descent of the lifting device;

d) further including a means for controlling descent of the lifting device when the lifting device normally moving downwardly and begins to descend uncontrollably;

e) wherein said control means includes an hydraulic velocity fuse in fluid communication with said slave safety hydraulic cylinder, said velocity fuse triggered at a preselected fluid flow rate for controllably lowering the lifting device; and f) wherein said control means includes an hydraulic velocity fuse fluidly connected in series with a release solenoid defining a circuit A for allowing fluid flow through said velocity fuse when the lifting device is moving downwardly and for closing off said circuit A when the lifting device is stationary or moving upwardly.

17. The anti fall device claimed in claim 16, further including a lowering means for manually lowering the lifting device at a controlled rate of descent.

18. The anti fall device claimed in claim 17 wherein said lowering means including a normally closed manual lowering valve fluidly connected to a circuit B which is in parallel to circuit A for manually controlling hydraulic fluid flow to said slave safety hydraulic cylinder thereby manually lowering said lifting device.

19. The anti fall device claimed in claim 18 wherein said control means housed within a safety manifold which is in fluid communication with said slave safety hydraulic cylinder.

* * * * *

UNITED STATES PATENT AND TRADEMARK OFFICE

CERTIFICATE OF CORRECTION

PATENT NO. : 6,854,715 B2
DATED : February 15, 2005
INVENTOR(S) : Chris Hicks et al.

It is certified that error appears in the above-identified patent and that said Letters Patent is hereby corrected as shown below:

Column 6,
Line 45, "descend uncontrollably; and" should be -- descend uncontrollably; --.

Column 7,
Line 25, "assembly of assembly of" should be -- assembly of --.
Line 30, "hydraulic under moving" should be -- hydraulic cylinder moving --.

Signed and Sealed this

Sixth Day of September, 2005

JON W. DUDAS
*Director of the United States Patent and Trademark Office*